US008720455B2

(12) United States Patent
Molet

(10) Patent No.: US 8,720,455 B2
(45) Date of Patent: May 13, 2014

(54) CLOSED-CIRCUIT INSTALLATION FOR THE SURFACE-TREATMENT OF COMPONENTS IN A LIQUID BATH

(75) Inventor: Herve Molet, La Celle Saint Avant (FR)

(73) Assignee: SNECMA, Paris (FR)

( * ) Notice: Subject to any disclaimer, the term of this patent is extended or adjusted under 35 U.S.C. 154(b) by 514 days.

(21) Appl. No.: 13/081,065

(22) Filed: Apr. 6, 2011

(65) Prior Publication Data

US 2011/0247664 A1 Oct. 13, 2011

(30) Foreign Application Priority Data

Apr. 7, 2010 (FR) ..... 10 52616

(51) Int. Cl.
*B08B 3/12* (2006.01)
*B08B 6/00* (2006.01)

(52) U.S. Cl.
USPC ..... 134/184

(58) Field of Classification Search
None
See application file for complete search history.

(56) References Cited

U.S. PATENT DOCUMENTS 3,551,301 A 12/1970 Cowen et al.
2005/0247556 A1 11/2005 Henry et al.
2008/0283501 A1 11/2008 Roy

FOREIGN PATENT DOCUMENTS

FR 2 842 536 1/2004
WO WO 2006/010888 A1 2/2006

OTHER PUBLICATIONS

French Preliminary Search Report issued Nov. 10, 2010, in French 1052616, filed Apr. 7, 2010 (with English Translation of Category of Cited Documents).

*Primary Examiner* — Jason Ko
(74) *Attorney, Agent, or Firm* — Oblon, Spivak, McClelland, Maier & Neustadt, L.L.P.

(57) ABSTRACT

An installation including a bath storage reservoir, a treatment tank to receive the component that is to be treated which is carried by a support tool collaborating with the tank, respective pipes for conveying the bath from the reservoir to the tank and for emptying the bath from the tank to the reservoir, and a motion instigating device for setting the bath in motion in the closed circuit is provided. The tank is of elongate shape with a longitudinal axis and a cross section that is substantially constant between the respectively upstream and downstream opposite transverse ends of the tank. The bath conveying and emptying pipes are respectively connected to the upstream and downstream ends of the elongate tank along the longitudinal axis thereof. The tooling carrying the component that is to be treated, which component is placed in the tank, is mounted fixedly thereon.

6 Claims, 1 Drawing Sheet

CLOSED-CIRCUIT INSTALLATION FOR THE SURFACE-TREATMENT OF COMPONENTS IN A LIQUID BATH

BACKGROUND OF THE INVENTION AND DESCRIPTION OF THE PRIOR ART

The present invention relates to an installation for the surface-treatment of components in a liquid bath flowing in a closed circuit.

More particularly, although not exclusively, this may be a (chemical) cleaning or electroplating (galvanoplasty) bath such as is used, for example, for creating a coating by electrolytic deposition of platinum or some other metal, on aircraft engine components.

Known present-day installations generally comprise:

- a bath storage reservoir;
- a treatment tank to receive the component that is to be treated which is carried by a support tool collaborating with the tank;
- respective pipes for conveying the bath from the reservoir to the tank and for emptying the bath from the tank to the reservoir and
- motion instigating means for setting the bath in motion in the closed circuit thus formed.

For example, in the case of treatment installations for actual cleaning proper, said means for setting the bath contained in the closed circuit in motion or for agitating said bath are formed of a recirculation pump which draws in the bath contained in the reservoir to convey it to the tank of parallelepipedal shape via the corresponding pipe that passes through a side wall of this tank, and delivers it from the treatment tank to the reservoir using the other pipe which leads out of the same side wall of the tank. A reciprocating rectilinear motion produced by the component holder tooling itself may be added to these means of setting the bath in motion if the tooling is given the ability to move with respect to the fixed tank, and thus contributes to the agitation of the tank.

In the case of treatment installations which perform electrolytic deposition or the like, the motion instigating means that set the bath contained in the closed circuit in motion once again comprise a recirculation pump. This pump conveys the bath through the relevant pipe from the reservoir to a holed spray boom situated toward the lower part of a side wall of the parallelepipedal tank, near its bottom, and then removes the bath to the reservoir via the other pipe associated with said wall and which extends from a tank overflow element situated in the upper part of this tank.

The component holder tooling may also contribute toward the agitating of the tank through a reciprocating rectilinear motion imparted to it.

With this type of parallelepipedal tank installation with means of setting the bath in motion (or of agitating the bath) using a recirculation pump and movement of the component holder tooling, there a number of disadvantages which arise notably as regards the speed of the treatment bath at the surface of the components that are to be treated.

First of all, because the speed is a resultant of the agitation performed by the recirculation pump and of the moving component hold causing tooling movements to become superposed, it is uneven and disordered (in terms of direction and in terms of intensity) at each point in the treatment tank, which means that it is very different at the center of the parallelepipedal tank compared to the corners thereof.

Moreover, it is difficult to quantify this speed either by physical measurement or by calculation because of the turbulent movement of the bath which is caused by the two sources of motion (the pump and the tooling), because of the angular shape of the tank and because the conveying and removal pipes are positioned on one and the same side wall. In addition, the speed of circulation of the bath cannot be altered to suit the components that are to be treated, the baths used or the desired electrolytic deposition conditions.

It is known in particular that, in galvanoplasty, deposition is dependent on the applied current strength and on the speed of the flow along the tank and therefore along the component that are to be treated. Thus, because it is difficult, for the abovementioned reasons, to control the speed, the bath containing the metallic and other species is not homogeneous at all points in the tank and this means that the quality of the deposit and the thickness thereof are not strictly constant over the entire surface of the components that are to be treated.

Elsewhere, document U.S. Pat. No. 3,551,301, discloses a method for equalizing the electrolytic deposits on a component, from a reservoir of electrolyte of square cross section with parallel anode plates, using conveying and removal pipes which are connected in an aligned fashion to the upstream and downstream ends of the reservoir and a moving support carrying the component that is to be treated. Particularly because the reservoir is of square cross section, the abovementioned problems remain.

SUMMARY OF THE INVENTION

It is an object of the present invention to remedy the above disadvantages and the invention relates to an installation the design of which makes it possible to guarantee a bath circulation speed that is substantially equal and quantifiable at every point in the treatment tank so as to obtain a uniform treatment, for example, a deposited layer of constant thickness evenly distributed over the surface of the components that are to be treated.

To this end, the installation for the surface-treatment of one or more components immersed in a liquid bath, of the closed-circuit type, and comprising:

- a bath storage reservoir;
- a treatment tank to receive the component that is to be treated which is carried by a support tool collaborating with the tank;
- respective pipes for conveying the bath from the reservoir to the tank and for emptying the bath from the tank to the reservoir, said bath conveying and emptying pipes being connected in an aligned fashion to the respective upstream and downstream ends of the tank; and
- motion instigating means for setting the bath in motion in the closed circuit thus formed, is notable, according to the invention, in that the tank is of cylindrical elongate shape with a longitudinal axis and a cross section that is substantially constant between the respectively upstream and downstream opposite transverse ends of the tank, said cross section being circular or of similar shape, or being partially circular with at least one flat part.

Thus, by virtue of the invention, through the absence of mobility of the tooling (which, when able to move, superposes its movements on those of the bath circulation flow), combined with an elongate tank of constant cross section and with the fact that the conveying and removal pipes are advantageously connected to the respective and opposite ends of the tank, the installation of the invention overcomes the disadvantages of the earlier installations.

Specifically, the flow or stream of the bath is at all points in the tank substantially constant and parallel to the genertrices of the elongate tank, from one end thereof to the other, because the tank forms a kind of uniform vein through which the bath flows. The circulation of the bath, which is given and sustained in the closed circuit by the means concerned, creates in the vein a controlled and sufficient movement to homogenize the bath, without disturbing it, with the metallic or other species it contains, this being something which is particularly desirable in the case of an electroplating bath.

It will therefore be understood that the speed of the bath in the tank, at the surface of the components, is thus controlled and readily quantifiable, either through physical measurement in the installation itself or through calculation, and that it is substantially equal at every point in the treatment tank.

The particularly simple way in which the elongate tank has been embodied in order to achieve high-performance treatment results, that is to say with a uniform and homogeneous flow along the vein thus created, without disturbance, is also of note. When the tank is partially circular, the flat part then accepts the component holder tooling.

For preference the diameter of the conveying and emptying pipes is at least similar to that of the constant cross section of the elongate tank. Thus, sudden changes in section between the respective pipes and the elongate tank, and the risks of flow agitation or turbulence that that could be created along the tank are avoided.

According to another feature of the invention, the installation further comprises a controllable regulating member for regulating the flow generated by the movement instigating means that set the bath in motion in the circuit, said controllable regulating member being situated on said conveying pipe near the upstream transverse end of the elongate tank. Thus, the flow rate of the bath and, therefore, its speed through the elongate tank, can be adapted to suit the desired treatment for the component in question, so as to optimize the efficiency of this treatment.

According to one particular embodiment, a cutout is made in the side wall of the elongate tank, and the component holder tooling then advantageously comprises a support plate able to fit into said cutout and be held in position there. Thus, the tooling support plate precisely follows the profile of the elongate tank, so that the flow of the bath is disturbed by the structure of the tooling as little as possible. That plays a part in keeping the bath in circulation with the most constant possible speed through the tank.

Should it prove necessary, a stop-off which is connected to said tooling is arranged around said component and masks a part thereof that is not to be treated.

In addition, said tooling carries at least one anode which is distant and isolated from the component that is to be treated, the latter forming a cathode, and the motion instigating means that set the bath in motion are defined by a recirculation pump arranged in the closed circuit.

BRIEF DESCRIPTION OF THE DRAWINGS

The figures of the attached drawing will make it easy to understand how the invention may be achieved. In these figures, identical references denote elements that are similar.

DESCRIPTION OF THE PREFERRED EMBODIMENT

Figure 1:
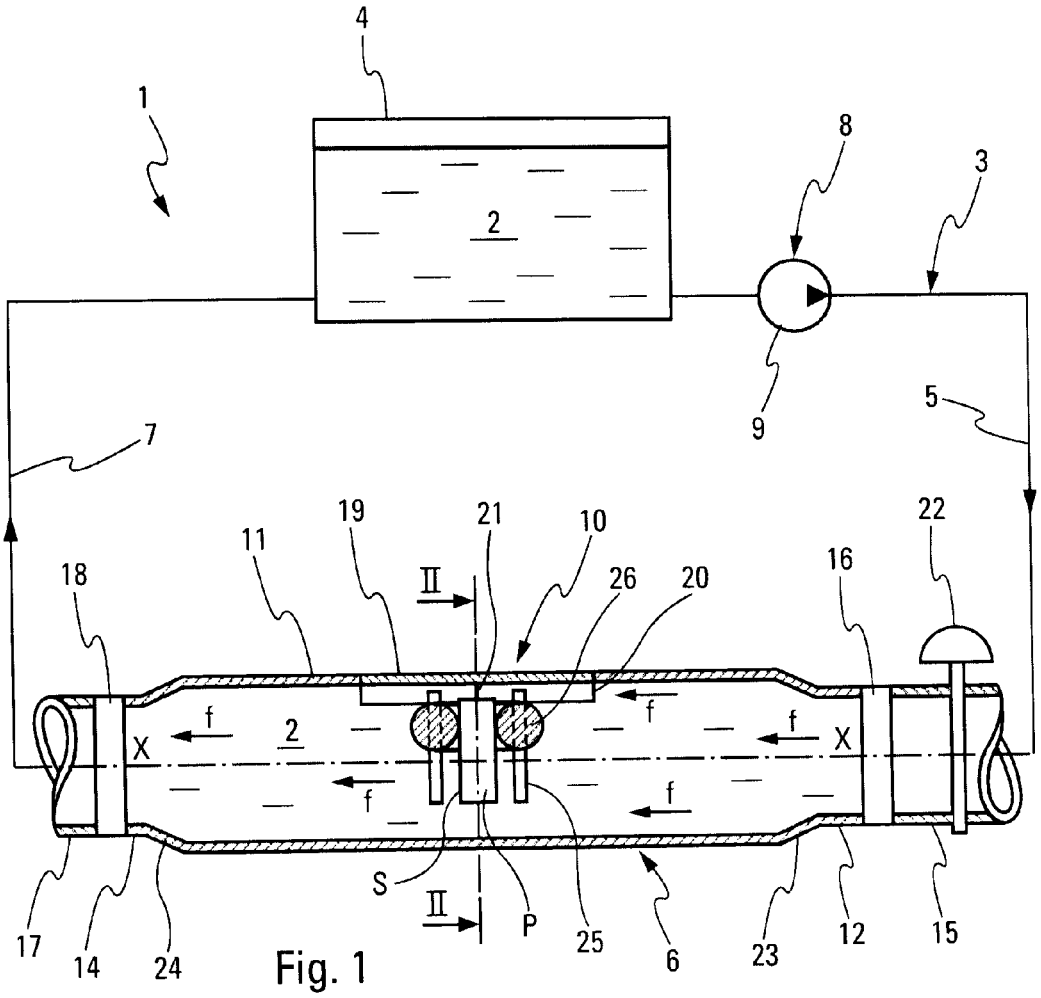
FIG. 1 shows a schematic exemplary embodiment of a liquid bath treatment installation according to the invention.

The installation 1 schematically depicted in FIG. 1 is intended for example for the electrochemical galvanoplasty treatment of the surface S of a component P in a liquid metal bath 2. A chemical treatment (cleaning, pickling, etc.) could of course be envisioned without departing from the scope of the invention, provided that there is a need to best homogenize the treatment bath. The component P that is to be treated, which has been depicted symbolically as a parallelepipedal block, is, for example, a turbomachine turbine blade which is to be coated with platinum by galvanoplasty.

To do that, the installation 1 defines a closed circuit 3 in which there are a storage tank 4 for the liquid metal bath 2, a conveying or feed pipe 5 for conveying or feeding the bath to a treatment tank 6, and a removal or delivery pipe 7 for removing or delivering the bath from the tank 6 to the storage reservoir 4. Circulation instigating means 8 that set the bath in motion in the closed circuit 3 are provided, these being situated on the outlet of the reservoir 4 and connected to the conveying pipe 5, and being defined by a recirculation pump 9.

The liquid metal bath 2 circulating in the closed circuit 3 of the installation is of course constantly replenished with appropriate species and the like in the storage reservoir so that it maintains its properties so that it can correctly treat the component P. This component is in the treatment tank 6 and is held in position there by a support tooling 10 associated with the tank and which will be discussed again later on.

Figure 2:
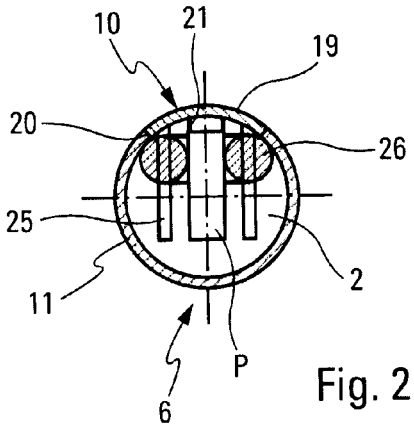
FIG. 2 is a cross section on II-II of FIG. 1 through the treatment tank of the installation.

According to the invention, the treatment tank 6 has an elongate shape preferably defined by a cylindrical wall 11 with a longitudinal axis X-X of symmetry having a cross section that is constant and, as shown by FIG. 2 circular. This constant circular cross section of the wall 11 extends the entire length between the respectively upstream 12 and downstream 14 transverse ends of the circular cylindrical tank 6, in the direction in which the bath 2 flows in the closed circuit 3. The end 15 of the feed pipe 5 is connected, by a coupling symbolized as 16, to the upstream transverse end 12 of the tank, and the corresponding end 17 of the delivery pipe 7 is connected by a coupling 18 to the downstream transverse end 14 of the tank, both along the longitudinal axis X-X of the tank. The ends 15, 17 of the two pipes thus lie on the opposite transverse ends 12, 14 of the treatment tank 6, being aligned coaxially along the longitudinal axis of symmetry X-X thereof.

Further, the support tooling 10 from which the component P is suspended, is fixed with respect to the treatment tank 6. For that purpose it comprises a bowed plate 19 which has a thickness and a transverse circular profile which are identical to those of the tank and which nest as a good fit in a cutout or aperture 20 made in the cylindrical wall 11 of the tank, at the upper part thereof as shown by FIGS. 1 and 2. This bowed plate 19 of the tooling 10, after fitting, fits into the tank and therefore perfectly follows notably the interior profile of the side wall 11 of the tank. The component P that is to be treated is kept suspended in the bath 2 circulating through the tank 6 by ties 21 or the like emanating from the plate 19. This plate is put into and taken out of the tank by a manipulator, not depicted.

Thus, thanks to the specific features of the invention 1, namely:

- the tank which is cylindrical with constant circular cross section;
- the fact that the bath enters and leaves the tank via the pipes 5 and 7 which are aligned along the axis X-X thereof and mounted on the opposite ends thereof; and
- the absence of movement of the component holder tooling and the continuity of the cylindrical profile thereof with the tank, the flow or stream of the bath 2 through the treatment tank 6 is substantially constant and parallel to the generatrices of the side wall 11 of the tank, as shown by the arrows f, without the problems of turbulent agitation experienced in the prior art. Thus, the speed of the flow flowing from the flow rate is therefore homogeneous and is as constant as possible at any point in the bath 2 circulating through the tank 6 and can easily be determined. Thus, because the speed of the bath (and therefore agitation thereof) is controlled and known both in terms of direction and in terms of intensity, the surface S of the component P that is to be treated can receive a deposit that is optimal both in terms of thickness, which is as constant as possible, and in terms of quality, that is to say with homogeneous distribution of species through the bath.

In addition, the homogeneous and uniform flow of the liquid treatment bath 2 inside the tank can be regulated by fitting a controllable shut-off member or member 22 upstream of the treatment tank 6 to act on the fluid flow rate generated by the recirculation pump 9. This controllable member 22 is, for example, positioned near end 15 of the feed pipe 5 (FIG. 1) or could be incorporated into the coupling 16 connecting the latter to the tank. The flow rates and, therefore, the velocity vectors at any point in the flow can thus be perfectly determined and regulated by action on the regulating member, making it possible best to fine-tune the characteristics of the layer that is to be deposited according to its chemical composition and to suit the type of component P that is to be treated.

It will also be noted that the diameters of the pipes 5, 7 are identical to one another and similar to the diameter of the cylindrical circular tank 6, a slight divergent frustoconical part 23 and convergent frustoconical part 24 respectively connecting the wall 11 of the tank to the upstream 12 and downstream 14 ends thereof. By having these similar diameters and frustoconical parts turbulence in the flow in the bath is limited. It might of course be possible to conceive of having the diameters of the pipes and of the cylindrical tank identical, so as to have a closed circuit 3 with a constant vein through which the passing flow circulates with no disturbance.

FIGS. 1 and 2 also depict two anodes 25 in the form of rods placed vertically, respectively one on each side of the component P that forms the cathode. The electrical connections for these anodes and for the component which pass through the curved plate 19 to a current generator, have not been indicated. Furthermore, a stop-off 26 of toric shape surrounds an upper part of the component P which, for various reasons, it is desired should not receive the coating. The parallel and vertical anodes 25 may have the toric stop-off passing through them, in a diametrically opposite manner, or may be offset therefrom.

An installation 1 with such a cylindrical tank 6 which is preferably circular (although other shapes of cross section could be envisioned) is particularly well suited to treating the surface S of components P via a chemical route (cleaning, pickling, etc.) or an electrochemical route (electroplating), etc. It should also be emphasized that, because the bath flow is constant and homogeneous in a field of speeds that is controlled and parallel to the genetrices of the tank and because the bath is continuously mixed or agitated by the pump, thus ensuring that the solution remains homogeneous, treatment times are shorter.

By way of example, for a storage reservoir 4 with a capacity of 50 liters and a treatment tank 6 with a capacity of 2-3 liters and a recirculation pump 9 flow rate of 800 l/h, the bath circulating through the tank is renewed of the order of 20 times, making it possible to obtain sufficient and continuous mixing that a suitably homogenized bath is ensured.

The invention claimed is:

1. An installation for the surface-treatment of one or more components immersed in a liquid bath, of a closed-circuit type, the installation comprising:

a bath storage reservoir having the liquid bath;

a treatment tank to receive the component that is to be treated;

a support tool that carries the component and collaborates with the tank;

pipes for conveying the bath from the reservoir to the tank and for emptying the bath from the tank to the reservoir, respectively, said bath conveying and emptying pipes being connected in an aligned fashion to respective upstream and downstream ends of the tank; and a motion instigating device that sets the bath in motion, wherein the tank is of cylindrical elongate shape with a longitudinal axis and a cross section that is substantially constant between the respectively upstream and downstream opposite transverse ends of the tank, said cross section being circular or of similar shape, or being partially circular with at least one flat part, and wherein the support tool includes a bowed plate having a thickness and circular profile which are substantially similar to a thickness and profile of the tank, the bowed plate being fixedly disposed in an aperture in the tank such that an internal profile of a side wall of the tank is continuous.

2. The installation as claimed in claim 1, wherein a diameter of the conveying and emptying pipes is similar to a diameter of the constant cross section of the elongate tank.

3. The installation as claimed in claim 1, further comprising a controllable regulating member for regulating the flow generated by the movement instigating device that sets the bath in motion in the circuit, said controllable regulating member being situated on said conveying pipe near the upstream transverse end of the elongate tank.

4. The installation as claimed in claim 1, wherein a stop-off which is connected to said support tool is arranged around said component and masks a part thereof that is not to be treated.

5. The installation as claimed in claim 1, wherein said support tool carries at least one anode which is distant and isolated from the component that is to be treated, the component forming a cathode, and the motion instigating device that set the bath in motion is defined by a recirculation pump arranged in the closed circuit.

6. The installation as claimed in claim 1, wherein the tank comprises a divergent frustoconical portion at the upstream end and a convergent frustoconical portion at the downstream end.

* * * * *